US010429774B2

(12) United States Patent
Okinaka

(10) Patent No.: US 10,429,774 B2
(45) Date of Patent: Oct. 1, 2019

(54) FIXING DEVICE HAVING SEPARATING MEMBER FOR SEPARATING SHEET FROM HEATING MEMBER AND IMAGE FORMING APPARATUS HAVING THE SAME

(71) Applicant: KYOCERA Document Solutions Inc., Osaka (JP)

(72) Inventor: Kentaro Okinaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/923,380

(22) Filed: Mar. 16, 2018

(65) Prior Publication Data

US 2018/0329343 A1 Nov. 15, 2018

(30) Foreign Application Priority Data

May 10, 2017 (JP) ..... 2017-094139

(51) Int. Cl.
*G03G 15/20* (2006.01)

(52) U.S. Cl.
CPC ..... *G03G 15/2028* (2013.01); *G03G 15/2053* (2013.01)

(58) Field of Classification Search
CPC ..... G03G 15/2085; G03G 15/2053
USPC ..... 399/323
See application file for complete search history.

(56) References Cited

U.S. PATENT DOCUMENTS 5,956,555 A * 9/1999 Chen ..... G03G 15/2057 399/329
8,989,641 B2 3/2015 Ikeda
2002/0098018 A1* 7/2002 Kamiya ..... G03G 15/2028 399/323

FOREIGN PATENT DOCUMENTS

JP 2004-125942 A 4/2004
JP 2013-11687 A 1/2013

* cited by examiner

*Primary Examiner* — Quana Grainger
(74) *Attorney, Agent, or Firm* — Studebaker & Brackett PC

(57) ABSTRACT

A fixing device includes a heating member, a pressing member and a separating member. The heating member heats a toner transferred on a sheet. The pressing member forms a pressing area with the heating member. The toner is pressed at the pressing area. The separating member comes into contact with an outer circumferential face of the heating member and separates the sheet passed through the pressing area from the heating member. The heating member has a contact area with which the separating member comes into contact and a non-contact area with which the separating member does not come into contact. The heating member has a larger outer diameter at the contact area than an outer diameter at the non-contact area.

7 Claims, 6 Drawing Sheets

COMPARATIVE EMBODIMENT

FIXING DEVICE HAVING SEPARATING MEMBER FOR SEPARATING SHEET FROM HEATING MEMBER AND IMAGE FORMING APPARATUS HAVING THE SAME

INCORPORATION BY REFERENCE

This application is based on and claims the benefit of priority from Japanese Patent application No. 2017-094139 filed on May 10, 2017, which is incorporated by reference in its entirety.

BACKGROUND

The present disclosure relates to a fixing device fixing a toner image on a sheet and an image forming apparatus including the fixing device.

An image forming apparatus is provided with a fixing device which heats and presses a toner image transferred on a sheet and fixes the toner image on the sheet. The fixing device includes a rotatable heating member heated by a heat source and a pressing member being pressed against the heating member to form a pressing area between the heating member and the pressing member. When the sheet on which the toner image is transferred passes through the pressing area, the toner image is heated and pressed to be fixed on the sheet. The fixing device further includes a separating member which comes into contact with the heating member and separates the sheet passed through the pressing area from the heating member.

Because the separating member comes into contact with the heating member, a fine offset toner adhered on a surface of the heating member is fused on the separating member, and then the heating member is scraped by the fused toner of the separating member. If a depth of the scraped portion increases, an image having white streak may be printed before the end of the lifetime of the fixing device. Against the problem, when a contact pressure between the separating member and the heating member is decreased, a separating failure for a specific sheet may occur. Alternatively, when the separating member reciprocates in an axis direction of the heating member to distribute the contact position between the separating member and the heating member, although some degree of effect can be obtained, it is difficult to keep the effect until the end of the lifetime of the fixing device.

Alternatively, a hard intermediate layer may be sometimes provided between a release layer and a primer layer of the heating member along a circumferential direction of the heating member. In addition, a cleaning member may be provided, which comes into contact with the non-contact portion where the separating claw (the separating member) does not come into contact with the heating member and collects the adhered substance produced by the fine offset toner.

However, when the intermediate layer is provided, the producing process for the heating member becomes complicate. In addition, the intermediate layer does not offer the effect for decreasing the abrasion of the release layer. When the cleaning member is provided, because it is required to add a new member, a cost may be increased and a control process for the cleaning member may be complicate. In addition, the cleaning performance may be decreased before the end of the lifetime of the fixing device.

SUMMARY

In accordance with an aspect of the present disclosure, a fixing device includes a heating member, a pressing member and a separating member. The heating member heats a toner transferred on a sheet. The pressing member forms a pressing area with the heating member. The toner is pressed at the pressing area. The separating member comes into contact with an outer circumferential face of the heating member and separates the sheet passed through the pressing area from the heating member. The heating member has a contact area with which the separating member comes into contact and a non-contact area with which the separating member does not come into contact. The heating member has a larger outer diameter at the contact area than an outer diameter at the non-contact area.

In accordance with an aspect of the present disclosure, an image forming apparatus includes an image forming part and the fixing device. The image forming part forms a toner image on a sheet. The fixing device fixes the toner image on the sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, a fixing device and an image forming apparatus according to one embodiment of the present disclosure will be described.

Figure 1:
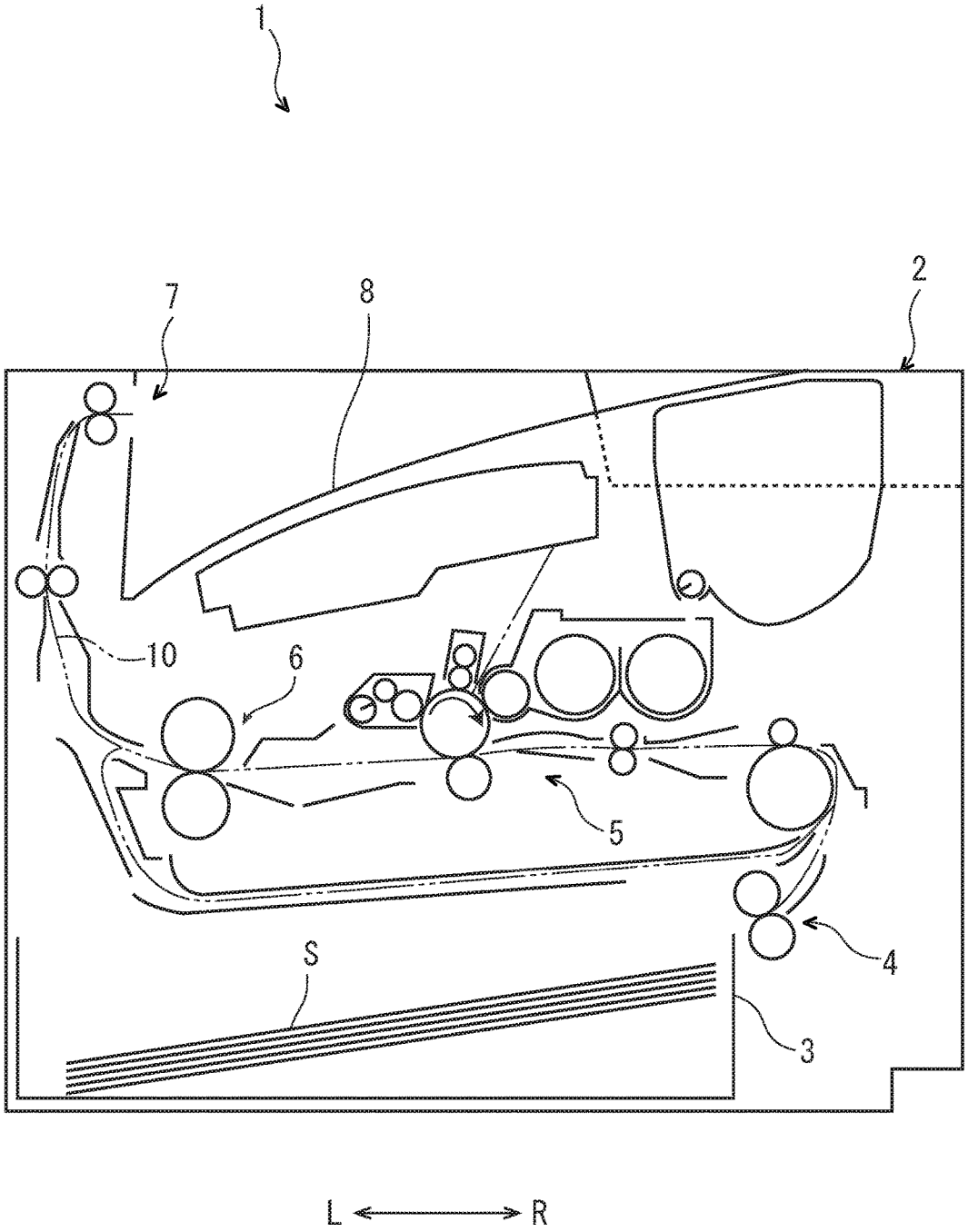
FIG. 1 is a front view schematically showing an inner structure of a printer according to one embodiment of the present disclosure.

With reference to FIG. 1, an entire structure of a printer 1 as an image forming apparatus will be described. FIG. 1 is a font view schematically showing an inner structure of the printer 1. In the following description, a near side (a front side) of a paper plan of FIG. 1 is decided to be a front side of the printer 1. In each figure, Fr, Rr, L and R respectively indicate a front side, a rear side, a left side and a right side.

An apparatus main body 2 of the printer 1 is provided with a sheet feeding cassette 3 storing a sheet S, a sheet feeding device 4 feeding the sheet S from the sheet feeding cassette 3, an image forming part 5 forming a toner image on the sheet S, a fixing device 6 fixing the toner image on the sheet S, an ejecting device 7 ejecting the sheet S and an ejected sheet tray 8 on which the ejected sheet S is stacked. In the apparatus main body 2, a conveying path 10 for the sheet S is formed so as to extend from the sheet feeding device 4 to the ejecting device 7 through the image forming part 5 and the fixing device 6.

The sheet S is fed by the sheet feeding device 4 from the sheet feeding cassette 3, and conveyed along the conveying path 10 to the image forming part 5. At the image forming part 5, the toner image is formed on the sheet S. The sheet S is conveyed along the conveying path 10 to the fixing device 6. The fixing device 6 fixes the toner image on the sheet S. The sheet S on which the toner image is fixed is ejected from the ejecting device 7, and then stacked on the ejected sheet tray 8.

Figure 2:
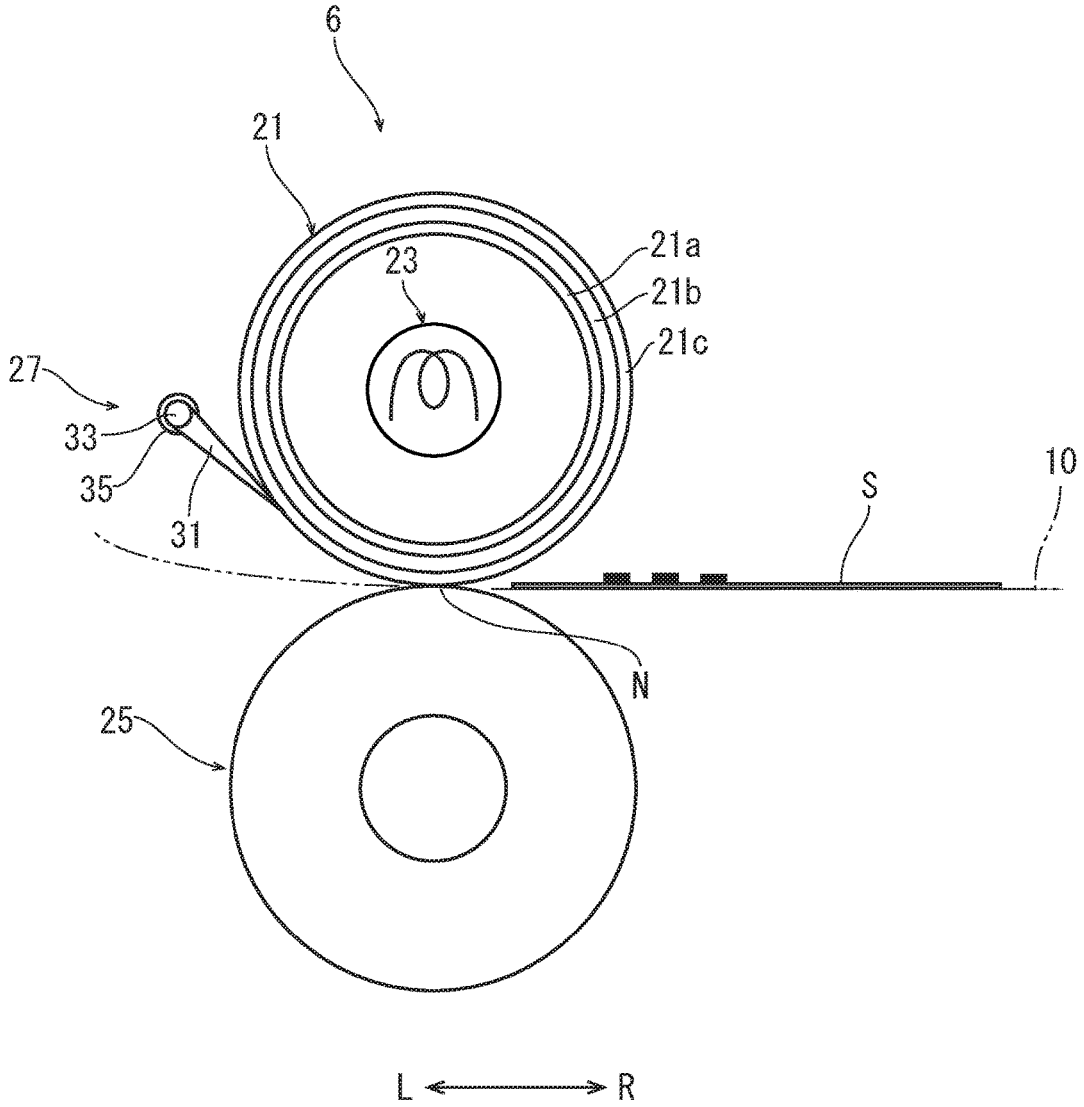
FIG. 2 is a sectional view showing a fixing device according to the embodiment of the present disclosure.
Figure 3A:
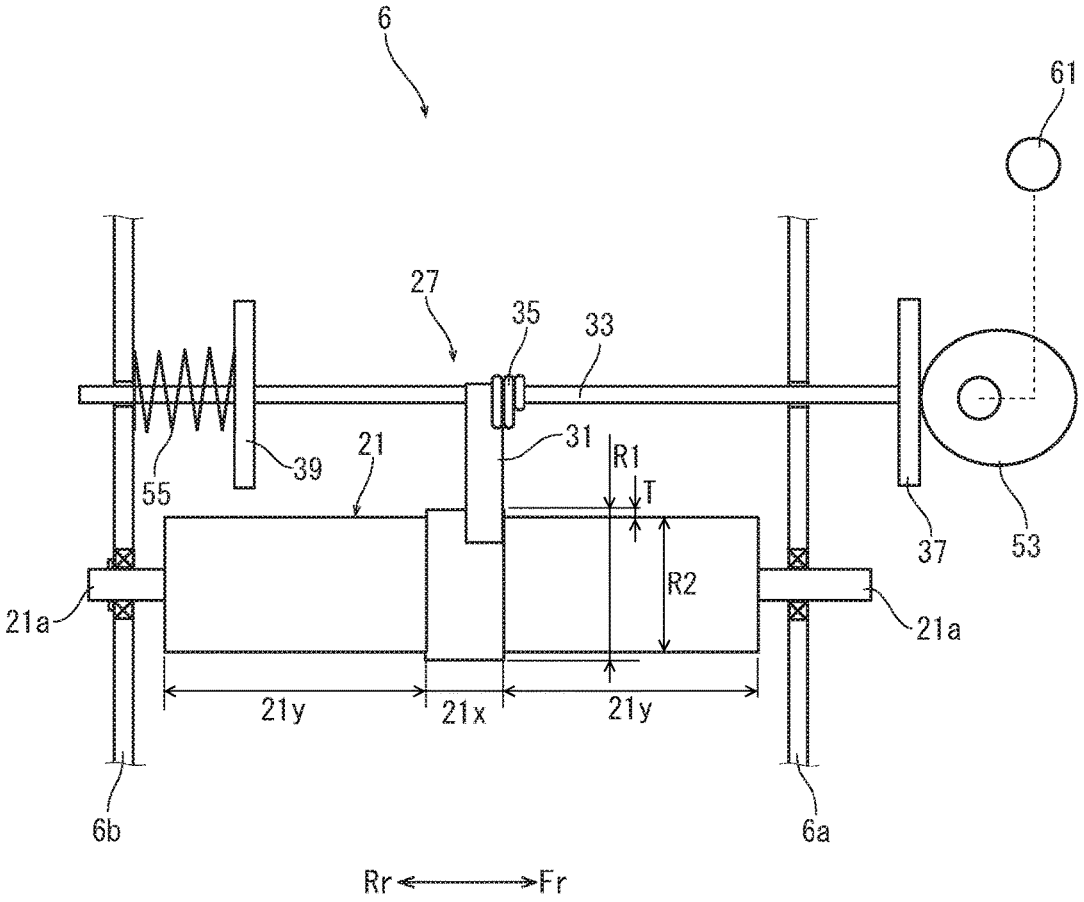
FIGS. 3A and 3B are side views showing the fixing device according to the embodiment of the present disclosure.
Figure 3B:
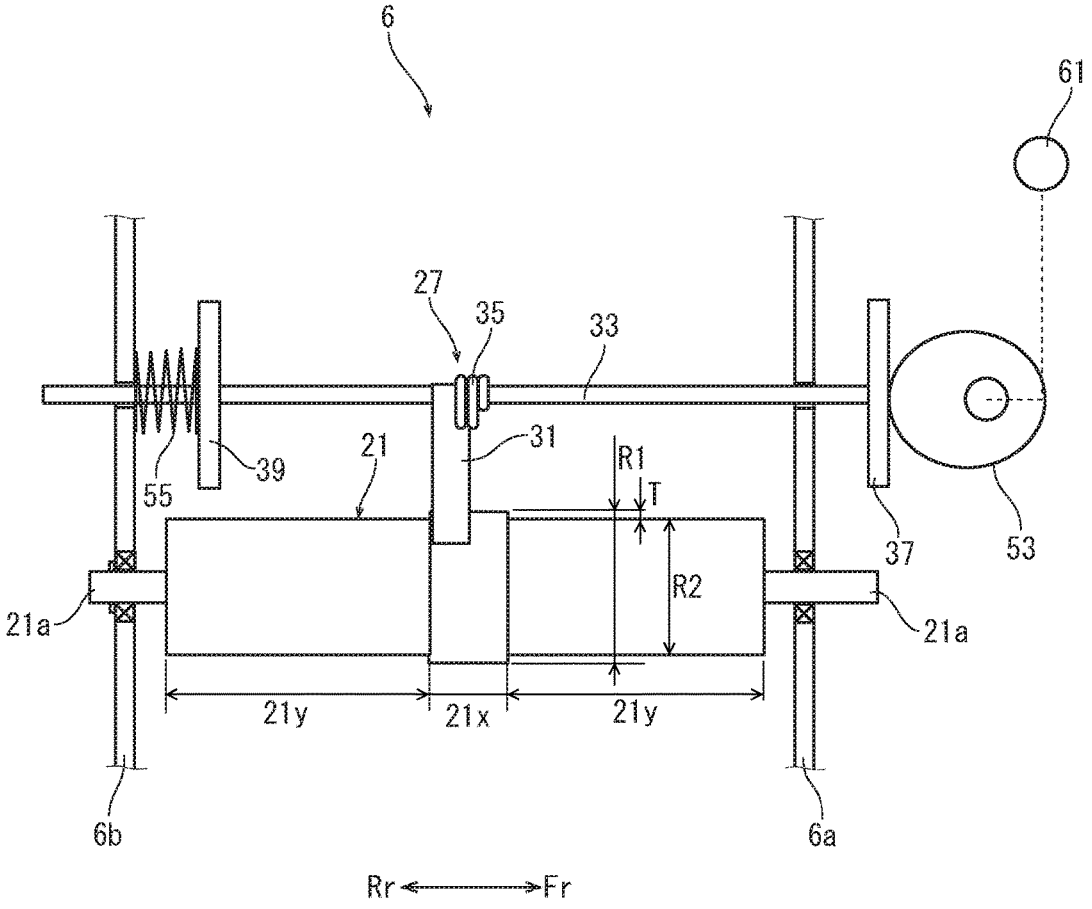

With reference to FIG. 2, FIG. 3A, and FIG. 3B, the fixing device 6 will be described. FIG. 2 is a sectional view showing the fixing device 6 and FIGS. 3A and 3B are side views showing the fixing device 6. FIGS. 3A and 3B schematically show a positional relationship between a separating member 27 and a heating roller 21.

The fixing device 6 includes a heating roller 21 as a heating member heating the toner, a halogen heater 23 heating the heating roller 21, a pressing roller 25 being pressed against the heating roller 21 from the lower side and forming a pressing area N where the toner is pressed and a separating member 27 which comes into contact with the heating roller 21 and separates the sheet S passing through the pressing area N from the heating roller 21.

The heating roller 21 includes a cylindrical core metal 21*a* and a release layer 21*c* provided around an outer circumferential face of the core metal 21*a* via a primer layer 21*b*. The release layer 21*c* is made of tetrafluoroethylene/perfluoroalkylvinyl ether copolymer (PFA). The heating roller 21 is supported by a fixing housing (not shown) so as to be rotatable around the core metal 21*a*, and driven by a motor (not shown) to be rotated.

As shown in FIGS. 3A and 3B, the heating roller 21 is made so as to have a larger outer diameter R1 at a center portion (hereinafter, called as a contact area 21*x*) in an axis direction of the core metal 21*a* than an outer diameter R2 at other portion (hereinafter, called as a non-contact area 21*y*) excepting the contact area 21*x*. In detail, the core metal 21*a* and the primer layer 21*b* each have a constant thickness in the axis direction while the release layer 21*c* has a larger thickness at the contact area 21*x* than a thickness at the non-contact area 21*y*. For example, a length of the contact area 21*x* in the axis direction is 7 mm, and a difference T between a radius (R1/2) of the heating roller 21 at the contact area 21*x* and a radius (R2/2) of the heating roller 21 at the non-contact area 21*y* (a difference in the thickness of the release layer 21*c*) is 5 μm to 8 μm.

The release layer 21*c* is made by the following manner, for example. Conventionally, the release layer is made by a spray coating method. In the spray coating method, while rotating the core metal around which the primer layer is made, a nozzle is moved from one end to the other end of an outer circumferential face of the primer layer in the axis direction at a constant feed rate. Thereby, the release layer is made to have a constant thickness in the axis direction. In the present embodiment, the feed rate of the nozzle is made slower at the contact area 21*x* than at the non-contact area 21*y* so that an amount of a material sprayed from the nozzle is larger at the contact area 21*x* than at the non-contact area 21*y*, and the release layer 21*c* has a thicker thickness at the contact area 21*x* than a thickness at the non-contact area 21*y*. However, the release layer 21*c* may be made by another method.

With reference to FIG. 2 again, the halogen heater 23 is disposed in an inside of the core metal 21*a* of the heating roller 21. The halogen heater 23 radiates radiant heat to an inner circumferential face of the heating roller 21 to heat the heating roller 21.

The pressing roller 22 includes a rotating shaft, an elastic layer provided around the rotating shaft and a release layer provided around the elastic layer. The pressing roller 25 is rotatably supported by the fixing housing and pressed against the heating roller 21 from the lower side. Thereby, the pressing area N is formed between the pressing roller 25 and the heating roller 21.

The separating member 27 includes a separating claw 31, an operating shaft 33 supporting the separating claw 31 and a torsion coil spring 35 disposed between the separating claw 31 and the operating shaft 33. The separating claw 31 is a triangular member, viewed from the side, having a sharp tip end, as shown in FIG. 2. A length (a width) of the separating claw 31 in the axis direction is 3 mm, for example. As shown in FIGS. 3A and 3B, a pressed plate 37 is fixed to a front end of the operating shaft 33, and a stopper plate 39 is fixed to a rear end portion of the operating shaft 33. The separating claw 31 is rotatably supported by the operating shaft 33 almost at a center between the pressed plate 37 and the stopper plate 39.

The torsion coil spring 35 has a coil part and two arm parts. An angle between the two arm parts is 90 degree at an unloaded state. The coil part is disposed around the operating shaft 33, one of the arm parts is fixed to the operating shaft 33 and the other of the arm parts is fixed to the separating claw 31. The torsion coil spring 35 biases the separating claw 31 with respect to the operating shaft 33 in the counterclockwise direction in FIG. 2.

As shown in FIG. 2, the separating member 27 is disposed at the downstream side of the pressing area N in the conveying direction. The operating shaft 33 is supported by the fixing housing in a parallel posture with the core metal 21*a* of the heating roller 21 and is movable in the axis direction, as described later. The separating claw 31 is pressed against the heating roller 21 at the contact area 21*x* by biasing force of the torsion coil spring 35 from a counter direction to a rotating direction of the heating roller 21.

A front end portion (a portion at the rear side of the pressed plate 37) of the operating shaft 33 and the rear end portion (a portion at the rear side of the stopper plate 39) are rotatably supported by a front side plate 6*a* and a rear side plate 6*b* of the fixing housing, respectively.

As shown in FIGS. 3A and 3B, a cam 53 rotating around an axis perpendicular to the axis direction of the operating shaft 33 is disposed at the front side of the pressed plate 37. A spring 55 is disposed between the stopper plate 39 and the rear side plate 6*b*. The spring 55 biases the stopper plate 39, that is, the operating shaft 33 forward with respect to the rear side plate 6*b* to make the pressed plate 37 come into contact with the cam 53.

The pressed plate 37 is pressed in the axis direction by rotating of the cam 53 and biasing force of the spring 55 so that the operating shaft 33 reciprocates in the axis direction. At this time, the separating claw 31 reciprocates within a predetermined area while coming into contact with the heating roller 21. The reciprocating area of the separating claw 31 (an area between an outer side edge of the separating claw 31 when the separating claw 31 is moved in one direction and the other outer side edge of the separating claw 31 when the separating claw 31 is moved in the other direction) is made to be matched with the contact area 21*x*. The reciprocating area of the separating claw 31 may be wider than the contact area 21*x* if the separating claw 31 necessarily comes in contact with the heating roller 21 at the contact area 21*x* when the separating claw 31 reciprocates in the one direction and the other direction.

In the fixing device 6 having the above configuration, when the heating roller 21 is driven to be rotated, the pressing roller 25 pressed against the heating roller 21 at the pressing area N is driven to be rotated, and the sheet S is passed through the pressing area N. At the pressing area N, the toner image transferred on the sheet S is heated and pressed to be fixed on the sheet S. The sheet S on which the toner image is fixed is conveyed along the conveying path 10 from the pressing area N. At this time, the sheet S is separated from the heating roller 21 by the separating claw 31 of the separating member 27.

At the same time as the driving of the heating roller 21, a drive motor 61 for driving the cam 53 is driven, and the separating claw 31 of the separating member 27 reciprocates in the axis direction (a direction perpendicular to the conveying direction for the sheet S) within the contact area 21*x* (the reciprocating area). This distributes the contact position between the separating claw 31 and the heating roller 21 within the contact area 21*x* in the axis direction. As described above, because the reciprocating area of the separating claw 31 is matched with the contact area 21*x*, the separating claw 31 can reciprocate smoothly without being caught by side edges of the contact area 21*x*.

During the fixing operation, the release layer 21*c* is gradually worn by coming into contact with the sheet S. In addition, the release layer 21*c* is further worn at the contact area 21*x* by coming into contact with the separating claw 31 reciprocating within the contact area 21*x*. That is, the release layer 21*c* at the contact area 21*x* is worn faster than the release layer 21*c* at the non-contact area 21*y*. However, because the release layer 21*c* has a larger outer diameter at the contact area 21*x* than at the non-contact area 21*y*, an absolute difference in height between the outer circumferential face of the release layer 21*c* at the contact area 21*x* after the wear by the separating claw 31 and the outer circumferential face of the release layer 21*c* at the non-contact area 21*y* is reduced after a predetermined fixing operation. That is, a depth of a recess produced by the wear can be made shallow.

Figure 4:
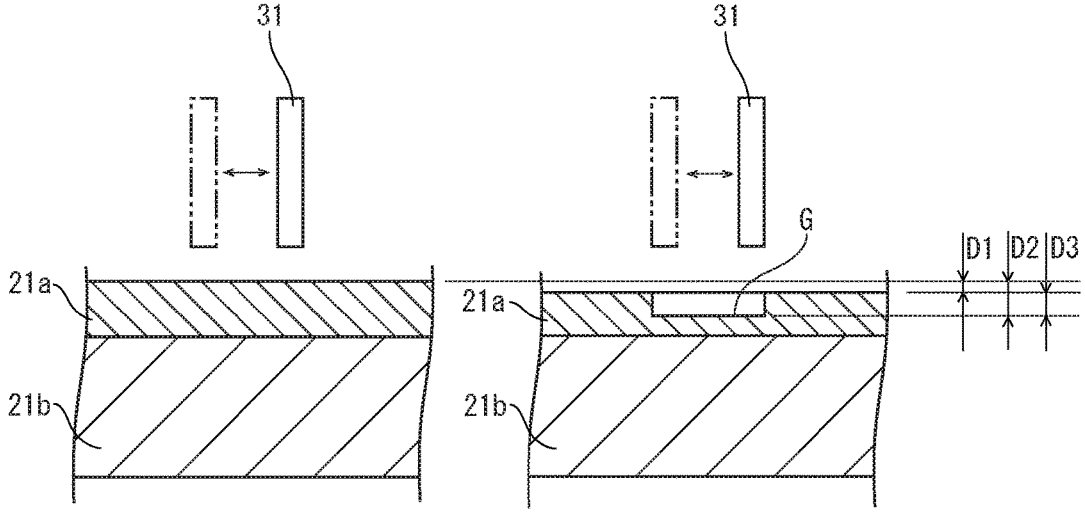
FIG. 4 is a sectional view showing a heating roller at an initial state and after a durability test, in a fixing device according to a comparative embodiment.
Figure 5:
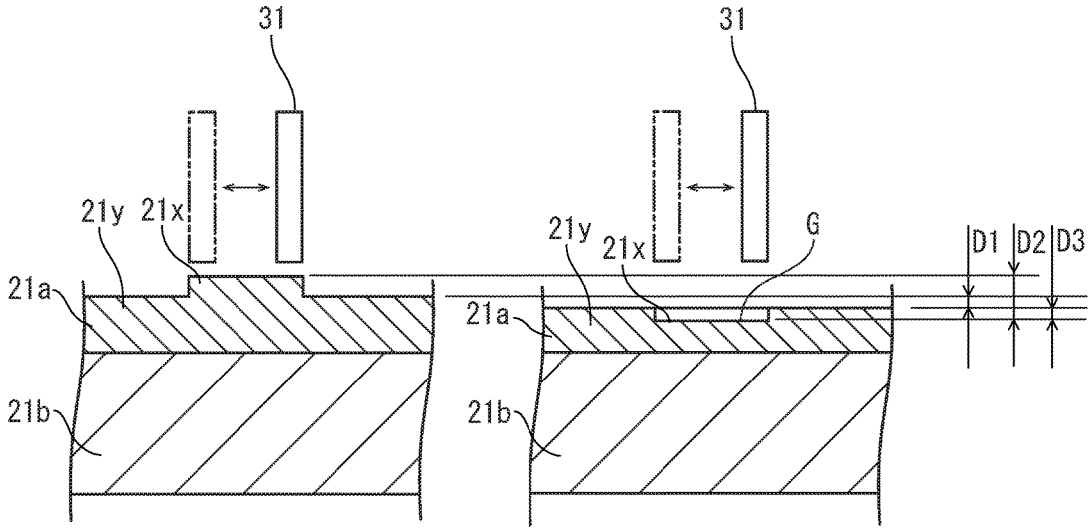
FIG. 5 is a sectional view showing a heating roller at an initial state and after a durability test, in the fixing device according to the embodiment of the present disclosure.

Next, an experimental example will be described with reference to FIG. 4 and FIG. 5. FIG. 4 is a sectional view showing the worn release layer in a comparative embodiment and FIG. 5 is a sectional view showing the worn release layer in the present embodiment. Each left figure in FIG. 4 and FIG. 5 shows the release layer at an initial state and each right figure in FIG. 4 and FIG. 5 shows the release layer after a durability test.

With reference to FIG. 4, as the comparative embodiment, the conventional fixing device which includes the heating roller 21 having the release layer 21*c* of a constant thickness will be described. The conventional fixing device is attached to an experimental machine, and a durability test for printing 300K of the sheets S (300,000 sheets S) is carried out. As a result, an entire area of the release layer 21*c* is worn with respect to the initial outer circumferential face by coming into contact with the sheet. A depth D1 of the worn portion (a scraped depth) is 2 μm. In addition, at the reciprocating area of the separating claw 31, the release layer 21*c* is worn with respect to the initial outer circumferential face by coming into contact with the sheet and the separating claw 31. The depth D2 of the worn portion is 10 μm. By the wear, an annular recess G is formed in the heating roller 21. That is, a depth D3 of the recess G with respect to a reference face after the durability test (the outer circumferential face after the wear by coming into contact with the sheet) is 8 μm. In the fixing device, when a half image is printed, an image having white streak is printed at the reciprocating area.

On the other hand, as the present embodiment, the fixing device 6 which includes the heating roller 21 which has a larger radius at the contact area 21*x* than a radius at the non-contact area 21*y* by 5 μm is attached to the experimental machine, and the durability test for printing 300K of the sheets S (300,000 sheets S) is carried out. As a result, as shown in FIG. 5, an entire area of the release layer 21*c* is worn with respect to the initial outer circumferential face by coming into contact with the sheet S. The depth D1 of the worn portion (the scraped depth) is 2 μm. In addition, at the contact area 21*x*, the release layer 21*c* is worn with respect to the initial outer circumferential face by coming into contact with the sheet and the separating claw 31. The depth D2 of the worn portion is 10 μm. By the wear, an annular recess G is formed in the heating roller 21. That is, a depth D3 of the recess G with respect to a reference face after the durability test (the outer circumferential face after the wear by the coming into contact with the sheet) is 3 μm. In the fixing device 6, when the half image is printed, an image having no white streak is printed at the contact area 21*x*.

Additionally, after the durability test for 500K of the sheets S, which is the end of the lifetime of the fixing device 6, the depth of the recess G with respect to the reference face after the durability test is 6 μm. An image having no white streak is printed at the half image printing.

As described above, in the fixing device 6 according to the present disclosure, the heating roller 21 has a larger outer diameter at the contact area 21*x* where the wear proceeds rapidly than an outer diameter at the non-contact area 21*y*. Thereby, after a predetermined fixing operation, an absolute difference in height between the outer circumferential face of the heating roller 21 at the contact area 21*x* and the outer circumferential face of the heating roller 21 at the non-contact area 21*y* is reduced. That is, it becomes possible to make the depth of the recess produced when the heating roller 21 is worn by coming into contact with the separating claw 31 shallow. Accordingly, it becomes possible to prevent the image having white streak caused by the recess and to use the fixing device until the end of its lifetime.

In addition, a difference between the radius (R1/2) of the heating roller 21 at the contact area 21*x* and the radius (R2/2) of the heating roller 21 at the non-contact area 21*y* is set to be 5 μm to 8 μm. This prevents the image having white streak at the initial state.

In addition, because the release layer 21*c* is formed on the outer circumferential face of the heating roller 21, it becomes possible to separate the sheet from the heating roller 21 suitably. If the release layer 21*c* may be made by the spray coating method, it becomes possible to make the heating roller 21 having a larger outer diameter at the contact area 21*x* than that at the non-contact area 21*y* by a simple way where the feeding rate of the nozzle is made lower at the contact area 21*x* than at the non-contact area 21*y*.

In addition, because the separating claw 31 reciprocates to distribute the contact position between the separating claw 31 and the heating roller 21, it becomes possible to reduce the local wear of the heating roller 21. However, the present disclosure can be applied to the fixing device in which the separating claw 31 does not reciprocate.

While the preferable embodiment and its modified example of the fixing device and the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

The invention claimed is:

1. A fixing device comprising:

a heating member heating a toner transferred on a sheet;

a pressing member forming a pressing area with the heating member, the toner being pressed at the pressing area; and a separating member contacting an outer circumferential face of the heating member and separating the sheet passed through the pressing area from the heating member, wherein the heating member has a contact area and a non-contact area in an axis direction perpendicular to a conveying direction of the sheet, and the contact area has a larger outer diameter than the non-contact area, and the separating member is in contact with the contact area, and is not in contact with the non-contact area.

2. The fixing device according to claim 1, wherein a difference between a radius of the heating member at the contact area and a radius of the heating member at the non-contact area is 5 μm to 8 μm.

3. The fixing device according to claim 1, wherein the heating member includes a release layer at the outer circumferential face, and a thickness of the release layer at the contact area is thicker than at the non-contact area.

4. The fixing device according to claim 3, wherein the release layer is made by a spray coating method.

5. The fixing device according to claim 1, wherein the separating member reciprocates within a predetermined area along the axis direction.

6. The fixing device according to claim 5, wherein the area where the separating member reciprocates is matched with the contact area.

7. An image forming apparatus comprising:

an image forming part forming a toner image on a sheet, and the fixing device according to claim 1, which fixes the toner image on the sheet.

* * * * *